US007267168B1

(12) United States Patent
Sipos

(10) Patent No.: US 7,267,168 B1
(45) Date of Patent: Sep. 11, 2007

(54) SPIDER WITH DISCRETE DIE SUPPORTS

(76) Inventor: David L. Sipos, 800 Carriage Light Loop, Youngsville, LA (US) 70592

( * ) Notice: Subject to any disclaimer, the term of this patent is extended or adjusted under 35 U.S.C. 154(b) by 280 days.

(21) Appl. No.: 10/949,151

(22) Filed: Sep. 24, 2004

(51) Int. Cl.
*E21B 19/10* (2006.01)

(52) U.S. Cl. ..... 166/77.52; 166/77.53; 166/75.14; 166/98; 175/423

(58) Field of Classification Search ..... 166/77.52, 166/77.53, 88.2, 75.14, 98; 175/423; 294/102.1, 294/102.2; 267/125
See application file for complete search history.

(56) References Cited

U.S. PATENT DOCUMENTS

| | | | | |
|---|---|---|---|---|
| 2,127,108 | A | 8/1938 | Driscoll | |
| 4,306,339 | A | 12/1981 | Ward | |
| 4,332,062 | A | 6/1982 | Byrne, Jr. | |
| 5,451,084 | A * | 9/1995 | Jansch | 294/1.1 |
| 5,595,248 | A | 1/1997 | Denny | |
| 5,848,647 | A * | 12/1998 | Webre et al. | 166/379 |
| 6,631,792 | B2 | 10/2003 | Buck | |
| 7,032,690 | B2 * | 4/2006 | Ramey et al. | 175/57 |
| 7,134,531 | B2 | 11/2006 | Ramey et al. | |
| 2003/0173117 | A1 * | 9/2003 | Mason et al. | 175/423 |
| 2006/0113074 | A1 * | 6/2006 | Baird | 166/77.51 |

FOREIGN PATENT DOCUMENTS

| | | | |
|---|---|---|---|
| JP | 02058694 | A * | 2/1990 |

* cited by examiner

*Primary Examiner*—David Bagnell
*Assistant Examiner*—Robert Fuller
(74) *Attorney, Agent, or Firm*—William Stagg; Chad Grand

(57) ABSTRACT

The spider, arranged for support on a drilling rig, is fitted with a plurality of slips peripherally distributed about a slip bowl. Each slip has a plurality of pipe gripping dies distributed vertically and resting on individual abutment surfaces on the slip. Each slip has a generally vertical slide way to receive mating surfaces on the die for radial constraint of the dies.

8 Claims, 2 Drawing Sheets

SPIDER WITH DISCRETE DIE SUPPORTS

This invention pertains to pipe string supporting oil field related apparatus such as spiders and elevators, with pipe gripping dies and related slips commonly used in earth drilling and servicing operations. More specifically, but not in a limiting sense, it relates to the individual support of dies carried by slips used in slip bowls of said apparatus.

BACKGROUND

Pipe strings supported in earth bore holes by drilling rigs are engaged by static spiders on drilling floors and by vertically movable elevators suspended by bails from traveling blocks of the rigs main hoisting gear. In many cases, there is little difference between spiders and elevators. Such arrangements are well known to those skilled in the related art.

When practical, it is desirable to support pipe strings that are vertically suspended in earth bore holes by engagement of plane surfaces on the pipe strings. When the pipe string has to be positioned with connections some distance above the usual drilling floor spider, for instance, there is usually no abutment available for the spider to grip.

To grip the cylindrical surface of the pipe, the spider, or elevator, is usually equipped with a plurality of slips distributed peripherally about the pipe and supported by a tapered slip bowl in the spider, or elevator, bore. The tapered bowl converts vertical pipe load to radial force that thrusts the slips against the pipe surface. The slips carry teeth, usually on an attached die, that bite into the pipe surface to provide the needed slippage resistance to support the pipe load. Ideally, the dies are so designed that they do as little damage to the pipe as possible without inviting slippage.

Pipe gripping dies are normally used in, vertically distributed, sets of three or more on each slip. The dies tend to slide downward on the supporting slips to which they are attached. In prior art, the dies rest one atop the other and the downward force on each die bears upon any die below. The cumulative load then is supported by abutment features on the related slip. The abutment feature can be overloaded and can deform the slip. In some cases, the pipe load has been dropped into the well with serious consequences. There is advantage in providing a discrete supporting abutment surface for each die to prevent the load accumulating on another abutment surface below.

SUMMARY OF INVENTION

The pipe string support assembly, a spider or elevator, has a body arranged for support on a drilling rig floor, and usually has ears for engagement by bails from a traveling block, both spider and elevator have a generally central pipe receiving opening with an upwardly opening, generally conical, slip bowl to receive a plurality of peripherally distributed slips, each slip is provided with a plurality of vertically distributed pipe gripping dies.

Each slip is configured to provide an individual abutting surface to support each die installed on the slip. Viewed in a plane containing the slip bowl centerline, there are a series of radially extending steps separated by a selected vertical dimension on the slip face adjacent the centerline. Each vertical separating surface below an abutting surface is closer to the centerline than the separating surface above the abutment.

Each die is arranged to engage a slide way on the related slip for radial confinement. The dies, preferably, have a vee shape opening toward the center line. The vee shape provides contact points on the pipe being gripped that have a preselected arc between the contact points regardless of the pipe diameter. The pipe can be gripped by contact points equally spaced about the pipe outer periphery. Alternately, the dies can have a generally cylindrical pipe gripping surface to generally mate with the gripped pipe outer surface.

The slip and die arrangement can be used in spiders and elevators of most known forms. They can also be manipulated vertically by slip manipulating apparatus now in common use on both spiders and elevators.

The features of this invention are identical in both spiders and elevators. For use in this disclosure the terms spider and elevator are used interchangeably and either term includes the other by definition. Further, by definition herein, either term, spider or elevator, includes slip manipulation gear as required to grip and release pipe. That is anticipated by and is within the scope of the claims.

These and other objects, advantages, and features of this invention will be apparent to those skilled in the art from a consideration of this specification, including the attached claims and appended drawings.

DETAILED DESCRIPTION OF DRAWINGS

In the formal drawings, features that are well established in the art and do not bear upon points of novelty are omitted in the interest of descriptive clarity. Such omitted features may include threaded junctures, weld lines, sealing elements, and connecting pins.

Figure 1:
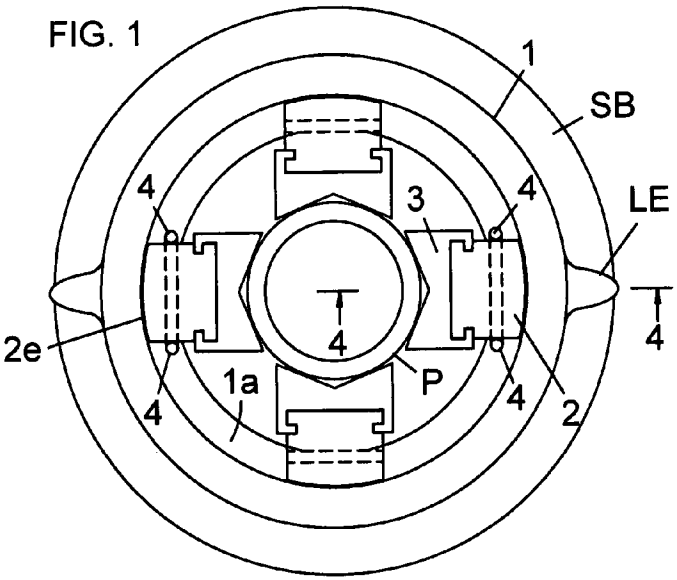
FIG. 1 is a top view of the spider assembly with a pipe situated vertically along the center line of the generally central opening.

In the drawings, wherein like features have like captions, FIG. 1 shows body 1 with an opening, to accept vertically suspended pipe, defined by conical surface 1*a* which carries slips 2, vertically controlled by elements 4, carrying a plurality of dies 3 to support pipe P. Support base SB and lifting ears LE enable function as spider or elevator respectively.

Figure 2:
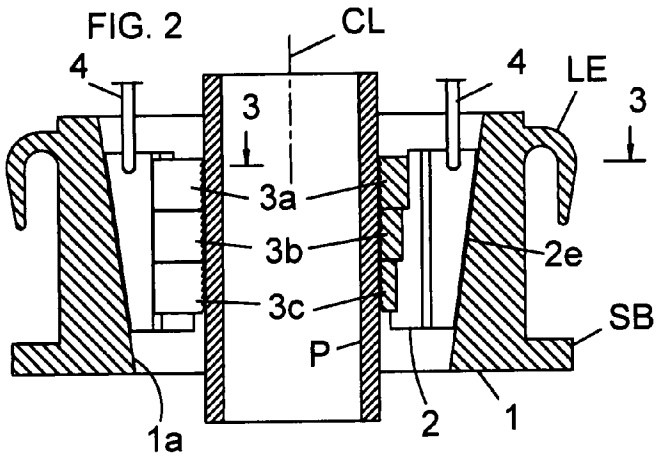
FIG. 2 is a side view, mostly in cutaway, taken by a plane cutting along the center line.

FIG. 2 is a section cut by a plane containing the opening center line CL. Only the body 1, pipe P, and one set of dies are sectioned. All top dies of plurality 3 are labeled 3*a*, the second dies are labeled 3*b* and the bottom dies are labeled 3*c*. Slip surfaces 2*e* mate with body conical surface 1*a*. When the slips are moved up or down, they move radially out or in respectively.

Figure 3:
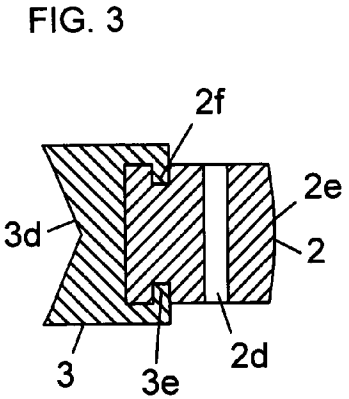
FIG. 3 is a section, enlarged, of a portion of the assembly taken along the line 3.

FIG. 3 is a section, rather enlarged, of only a portion of the assembly, taken along line 3. Dies 3 are a plurality. Slide way 2*f* is shown as a groove on each side of the slip. The groove is shown in rectangular section but may be a dovetail or other form. The dies have mating surfaces 3*e* to engage the groove for radial security. Cross bore 2*d* is symbolic to engage the lifting element 4 which is also symbolic. Many forms of spiders may be fitted with the novel slip and die configuration, and each form of spider may have a distinctive slip manipulation mechanism. Dies 3 have pipe gripping surfaces 3*d* to engage the outer surface of pipe suspended along the center line. The vee shape of the die surface 3*d* spans a preselected arc of pipe surface regardless of pipe diameter. Selected dies will accommodate a specific range of pipe outer surface diameters.

Figure 4:
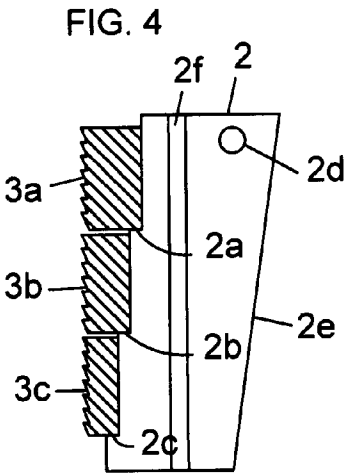
FIG. 4 is a section, enlarged, of a portion of the assembly taken along the line 4.

FIG. 4 is a sectional view, rather enlarged, of only a portion of the assembly taken along line 4. Dies 3*a*, 3*b*, and 3*c* rest on individual abutments 2*a*, 2*b*, and 2*c*.

Figure 5:
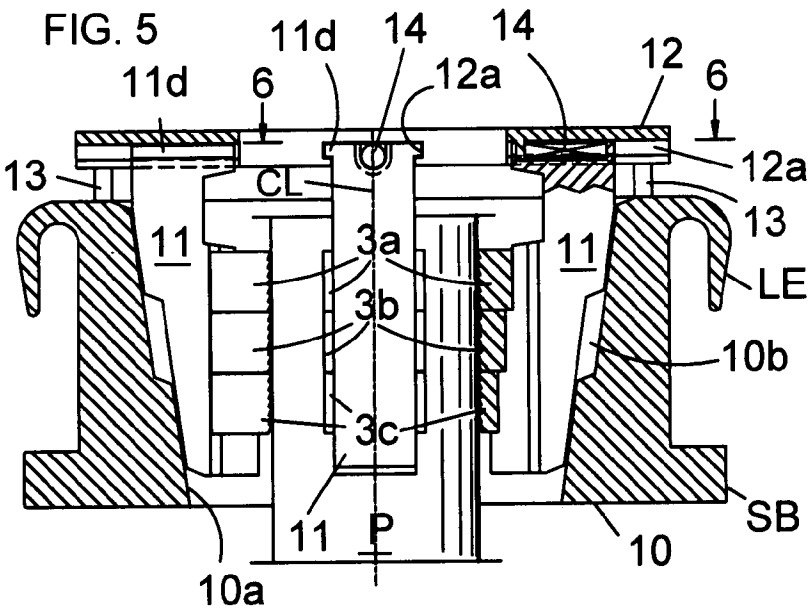
FIG. 5 is a side view, mostly cut away, of a spider or elevator with a stepped slip bowl and cooperating slip shape to provide a fall-back feature common to some apparatus.

FIG. 5 shows a body 10 with a step 10*b* in the slip bowl surface 10*a* to allow the stepped slips 11 to fall back radially, when lifted, to accept the vertical passage of such as pipe couplings, and other enlargements. Synchronizing plate 12 is moved vertically by rams 13, shown here out of position for clarity. Plate 12 has a slide way 12*a*, extending radially, to guide the slips by way of mating slip flange 11*d* on each slip. Dies 3*a*, 3*b*, and 3*c*, and their individual supporting abutment surfaces, are identical with those in FIGS. 1–4. Springs 14 urge the slips radially outward. There are several varied equivalents to the spring action now in field service. Several equivalents of the synchronizing plate, familiar to those in the drilling art, are in common use and can work well with the novel slips and dies of the invention.

Vertical center line CL defines the line of symmetry for the slip bowl, gripped pipe, slip features, and gripping surfaces of the dies.

Figure 6:
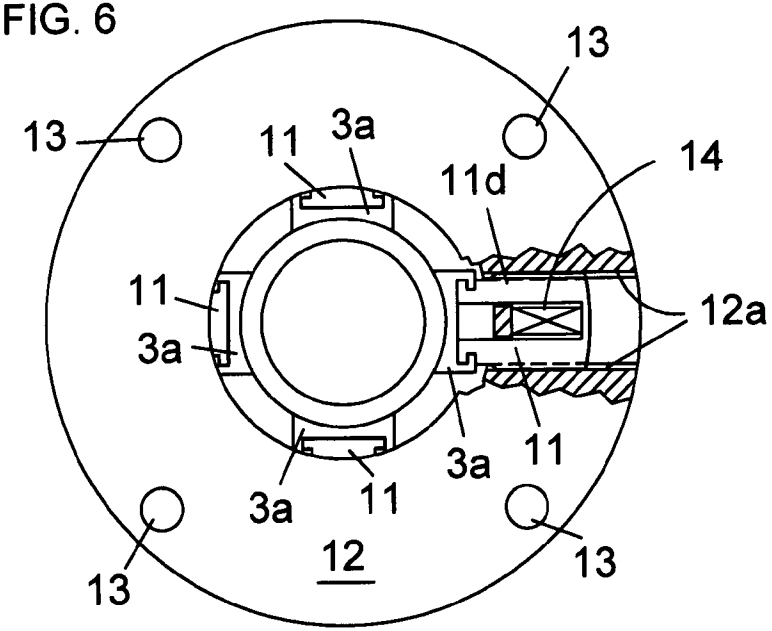
FIG. 6 is a top view of the apparatus of FIG. 5, with a partial section taken along line 6—6.

FIG. 6 shows the top view, the plate 12 primarily, with a partial cut away along line 6, showing the slip flange 11*d* guided by slide way 12*a*.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, I claim:

1. A pipe string load supporting spider for use on a drilling rig, the spider comprising:

a) a body arranged for support on said drilling rig, the body having a generally central opening to accept vertically extending pipe, the opening comprising a slip bowl with a vertical centerline, the slip bowl having a generally conical surface opening upwardly;

b) a plurality of slips peripherally distributed about said slip bowl, the slips having outer surfaces to mate with said conical surface and having individual abutment surfaces to support individual dies, each said die supported on said slip for vertical and radial movement therewith;

c) a plurality of, vertically distributed, said dies supported on each said slip and arranged to grip an outer surface of pipe when said pipe is supported along said centerline; and d) each of said plurality of dies arranged to slide vertically on a guideway on said slip to rest on one of said individual abutment surfaces.

2. The spider according to claim 1 wherein said dies have a vee shaped pipe gripping surface.

3. A pipe string load supporting elevator for use on a drilling rig, the elevator comprising:

a) a body arranged for support on said drilling rig, the body having a generally central slip bowl with a vertical centerline, the slip bowl having a generally conical surface opening upwardly;

b) a plurality of slips peripherally distributed about said slip bowl, the slips having outer surfaces to mate with said conical surface and having individual abutment surfaces to support each said die, each die supported on said slip for vertical and radial movement therewith;

c) a plurality of dies supported on each said slip and arranged to grip an outer surface of pipe when said pipe is supported along said centerline, each die supported on one said individual abutment surface; and d) each of said plurality of dies arranged to slide vertically on a guideway on said slip to rest on one of said individual abutment surfaces.

4. The elevator according to claim 3 wherein said dies have a vee shaped pipe gripping surface.

5. A pipe string load supporting spider for use on a drilling rig, the spider comprising:

a) a body arranged for support on said drilling rig, the body having a generally central opening to accept vertically extending pipe, the opening comprising a slip bowl with a vertical centerline, the slip bowl having a generally conical surface opening upwardly;

b) a plurality of slips peripherally distributed about said slip bowl, the slips having outer surfaces to mate with said conical surface and having individual abutment surfaces to support individual dies, each said die supported on said slip for vertical and radial movement therewith;

c) a plurality of, vertically distributed, said dies supported on each said slip and arranged to grip an outer surface of pipe when said pipe is supported along said centerline; and d) each said slip having said individual abutment surfaces distributed vertically, each comprising a horizontal plane, each plane extending nearer the center line than any such plane above.

6. The spider according to claim 5 wherein said dies have a vee shaped pipe gripping surface.

7. A pipe string load supporting elevator for use on a drilling rig, the elevator comprising:

a) a body arranged for support on said drilling rig, the body having a generally central slip bowl with a vertical centerline, the slip bowl having a generally conical surface opening upwardly;

b) a plurality of slips peripherally distributed about said slip bowl, the slips having outer surfaces to mate with said conical surface and having individual abutment surfaces to support each said die, each die supported on said slip for vertical and radial movement therewith;

c) a plurality of dies supported on each said slip and arranged to grip an outer surface of pipe when said pipe is supported along said centerline, each die supported on one said individual abutment surface; and d) each said slip having said individual abutment surfaces distributed vertically, each comprising a horizontal plane, each plane extending nearer the center line than any such plane above.

8. The elevator according to claim 7 wherein said dies have a vee shaped pipe gripping surface.

* * * * *